US005103992A

United States Patent [19]

Lippiello et al.

[11] Patent Number: 5,103,992

[45] Date of Patent: Apr. 14, 1992

[54] SHOE SEAL FOR FLOATING ROOF OF STORAGE TANK, AND METHOD OF INSTALLING SAME

[75] Inventors: Patrick L. Lippiello, Spring, Tex.; David W. Otto, Whittier, Calif.

[73] Assignee: HMT, Inc., Houston, Tex.

[21] Appl. No.: 762,650

[22] Filed: Sep. 19, 1991

Related U.S. Application Data

[63] Continuation of Ser. No. 510,542, Apr. 18, 1990, abandoned.

[51] Int. Cl.[5] ..... B65D 88/42

[52] U.S. Cl. ..... 220/221; 220/222; 220/224

[58] Field of Search ..... 220/216, 218, 221, 222, 220/224, 227

[56] References Cited

U.S. PATENT DOCUMENTS

| | | | |
|---|---|---|---|
| 2,478,422 | 8/1949 | Plummer | 220/224 |
| 2,536,019 | 1/1951 | Allen | 220/224 |
| 2,554,497 | 5/1951 | Moyer | 220/224 |
| 2,696,930 | 12/1954 | Moyer | 220/224 |
| 2,740,549 | 4/1956 | Graham et al. | 220/222 |
| 2,790,574 | 4/1957 | Consani | 220/221 |
| 2,801,763 | 8/1957 | Ulm | 220/224 |
| 2,803,371 | 8/1957 | Edens | 220/224 |
| 2,846,110 | 8/1958 | Stoyer | 220/224 |
| 2,936,925 | 5/1960 | Moyer et al. | 220/224 |
| 3,019,935 | 2/1962 | Anderson, Sr. | 220/224 |
| 3,048,298 | 8/1962 | Lessing et al. | 220/224 |
| 3,185,335 | 5/1965 | Lecler | 220/222 |
| 3,390,803 | 7/1968 | Smith | 220/224 |
| 3,589,549 | 6/1971 | Heisterberg | 220/222 |
| 3,595,432 | 7/1971 | Vander Heijden et al. | 220/224 |
| 4,258,858 | 3/1981 | Russell | 220/218 X |
| 4,353,477 | 10/1982 | Bruening | 220/222 X |
| 4,540,104 | 9/1985 | Kawai et al. | 220/224 |

*Primary Examiner*—Stephen Marcus
*Assistant Examiner*—Vanessa Caretto
*Attorney, Agent, or Firm*—Spensley Horn Jubas & Lubitz

[57] ABSTRACT

A shoe seal for sealing the space between a floating roof and the inner wall of an oil storage tank includes a plurality of scissors hanger assemblies for movably mounting a shoe on the floating roof. Each scissors hanger assembly includes an elongated plate suspended from a shoe clip bolted to the shoe and pivotally coupled to an opposite pair of elongated bars suspended from a rim clip bolted to the outer rim of the floating roof. In a first embodiment, the shoe is resiliently biased into contact with the inner tank wall by pusher bars bolted to the shoe and having resilient legs extending into contact with the floating roof, and pusher plates bolted to the roof and having a resilient leg extending into contact with the shoe. In a second embodiment, only the pusher bars are used and they are mounted on the rim clips bolted to the floating roof so that the opposite resilient legs thereof extend into contact with the shoe. A vapor barrier fabric extends between and is joined to the shoe and to the floating roof to complete the shoe seal. The shoe seal may be installed in a tank in service, inasmuch as no welding is needed. After lowering the shoe and attached scissors hanger assemblies into place between the inner tank wall and the floating roof, holes are drilled in the floating roof for bolting of the scissors hanger assemblies thereto. The resilient pusher bars and plates are bolted in place, and the vapor barrier fabric is bolted to the shoe and to the floating roof with the aid of channels.

17 Claims, 5 Drawing Sheets

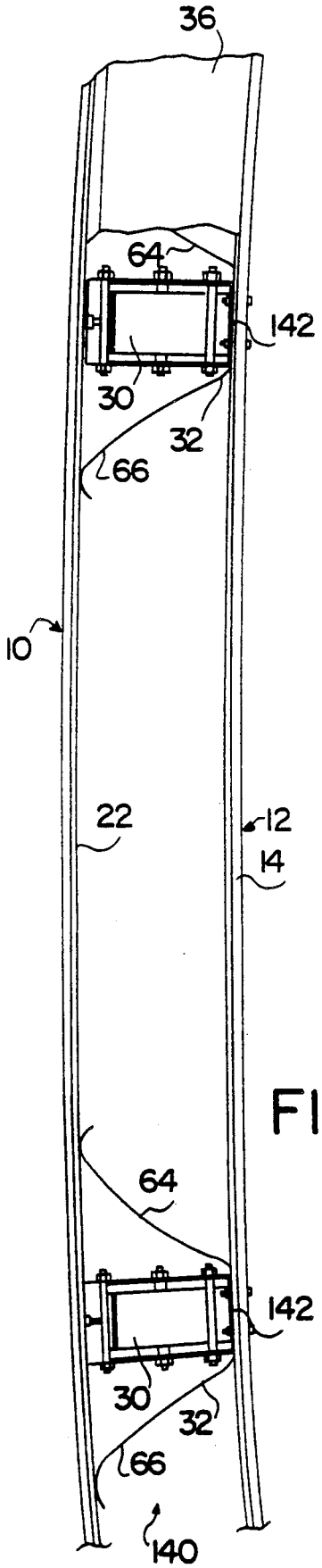
FIG. 11
FIG. 12
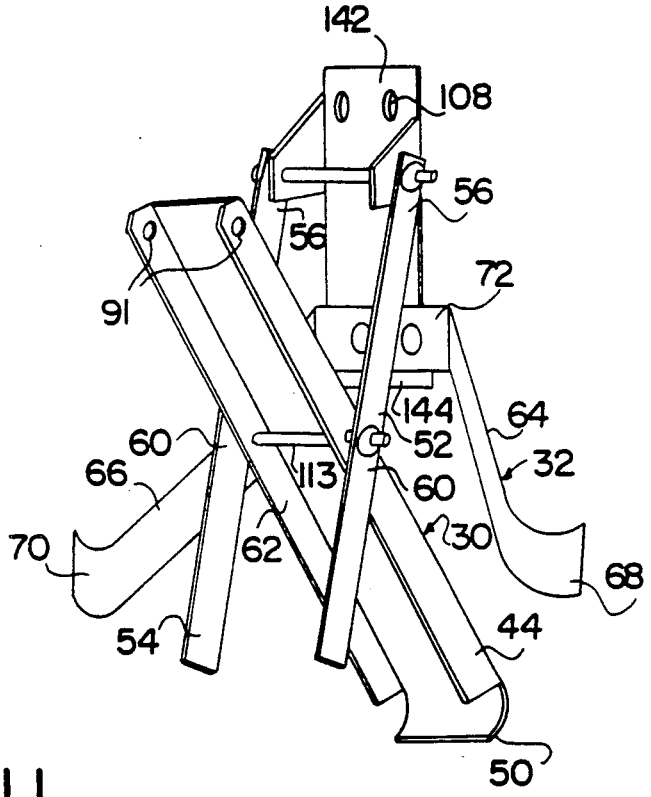

SHOE SEAL FOR FLOATING ROOF OF STORAGE TANK, AND METHOD OF INSTALLING SAME

This is a continuation of copending application Ser. No. 07/510,542 filed on Apr. 18, 1990, now abandoned.

BACKGROUND OF THE INVENTION

1. Field of the Invention

The present invention relates to shoe seals for sealing the space between a floating roof and an inner tank wall within a storage tank, and to methods of installing such shoe seals within the storage tank.

2. History of the Prior Art

It is standard practice in the field of large storage tanks such as oil storage tanks having floating roofs to provide the floating roof with a seal. Such seals act to seal the space between the outer rim of the floating roof and the inner tank wall, while at the same time allowing the floating roof to rise or drop as the height of the liquid product within the storage tank varies Such seals are necessary in order to prevent harmful hydrocarbon vapors from escaping through the space between the floating roof and the inner tank wall and entering the atmosphere.

Seals for floating roofs within storage tanks can assume a variety of different configurations. One such arrangement is shown in U.S. Pat. No. 4,308,968 of Thiltgen et al., which patent issued Jan. 5, 1982 and is commonly assigned with the present invention. The arrangement shown in the Thiltgen et al. patent includes two different seals, the first being a primary seal and the second being a backup or secondary seal The use of a secondary seal such as the one shown in the Thiltgen et al patent is sometimes necessary, due to the nature of the primary seal and to environmental requirements. The sealing arrangements shown in the Thiltgen et al patent utilize vapor barriers in combination with flexible metal plates and wiper blades. The vapor barriers, which are common in many floating roof seals, comprise one or more layers of fabric which are generally impermeable to vapors from the liquid product stored in the tank One type of floating roof seal which has been found to be quite effective, and which usually eliminates the need for a secondary seal, is the shoe seal Shoe seals employ a shoe in the form of a series of joined-together plates which are disposed against the inner wall of the tank and which are supported by the outer rim of the floating roof. A vapor barrier extending between the outer rim and the shoe provides an effective barrier to vapors from the liquid product in the tank, inasmuch as the lower portion of the shoe extends into the product.

Examples of shoe seals are provided by U.S. Pat. No. 2,981,438 of Heisterberg, which patent issued Apr. 25, 1961, U.S. Pat. No. 3,167,206 of Nelson, which patent issued Jan. 26, 1965, and U.S. Pat. No. 4,130,217 of Hills et al., which patent issued Dec. 19, 1978. In Heisterberg et al. the sealing mechanism is provided with a combination weatherhood and wax trough. The shoe is forced against the inner tank wall by spring-loaded pistons mounted within the outer rim of the floating roof. In Nelson, the shoe is suspended from the outer rim of the floating roof by a pivoting hanger structure designed to force the shoe against the inner tank wall. In Hills et al. various different members including springs are employed to maintain the shoe against the inner tank wall.

In spite of the advantages of shoe seals, presently known seals of this type typically suffer from certain limitations which may limit their effectiveness, their versatility and their ease of installation. For best performance, the shoe should be hung from the outer rim of the floating roof using hanger assemblies which support the shoe from the roof while at the same time allowing the shoe ample freedom to move toward or away from the roof as necessary to span the gap between the floating roof and the inner tank wall Such hanger assemblies are capable of accommodating variations in the space around the outer rim of the roof which can result from construction practices and from settling of the tank foundation. Present shoe seal designs also typically lack apparatus for maintaining the shoe in contact with the inner tank wall in an effective manner, particularly when combined with the advantages of pivoting hanger assemblies. Such conventional designs typically provide some urging of the shoe toward the inner tank wall without providing the uniform distribution of force on the shoe which may be necessary to maintain the shoe in engagement with the inner tank wall along substantially the entire length of the shoe. Various spring-like devices have proven unsuccessful, either because such devices become easily misaligned or dislocated with roof movement, or because such devices do not urge the shoe with the uniformity of pressure necessary to accommodate tank wall variations.

Further problems arise in connection with presently known shoe seals, from the standpoint of installation. Those seals requiring welding of various parts thereof to the floating roof, for example, necessitate that the tank be completely drained and the vapors removed therefrom before the seal can be installed on the roof. It would be highly advantageous to provide a shoe seal which can be installed while the tank is in service with the liquid product present therein. This dictates that the seal be installed relatively easily, and in any event without the need for welding or other procedures which would pose a danger of igniting a hydrocarbon product stored therein. For that matter, it would be desirable to be able to assemble those portions of the shoe seal which are preassembled outside of the tank without the need for welding.

BRIEF DESCRIPTION OF THE INVENTION

The foregoing and other objects and features in accordance with the invention are accomplished by providing an improved shoe seal which seals the space between the floating roof and the inner tank wall in a positive and effective manner and which at the same time is easily assembled and installed without the need for welding so as to permit installation of the seal in tanks which are in service Shoe seals in accordance with the invention employ scissors hanger assemblies in combination with separate resilient elements extending between the shoe and the floating roof This provides for mounting of the shoe on the roof in a flexible manner so as to accommodate varied and changing spaces between the floating roof and the inner tank wall At the same time, the shoe is maintained closely adjacent or in contact with the inner tank wall along substantially the entire length of the shoe The scissors hanger assemblies may include an elongated plate pivotally coupled at an upper end thereof to a shoe clip bolted to the shoe and extending downwardly and across the space between the shoe and the outer rim of the floating roof and into contact with the floating roof at a lower end thereof Each scissors hanger assembly also includes a pair of elongated bars pivotally coupled at their upper ends to a rim clip bolted to the outer rim of the floating roof and extending generally downwardly and away from the outer rim of the floating roof Intermediate portions of the elongated bars are pivotally coupled to an intermediate portion of the elongated plate to provide the desired scissors action which permits substantial lateral movement of the shoe relative to the outer rim of the floating roof while inhibiting rotational motion of the shoe.

In a first embodiment of a shoe seal, the shoe is resiliently urged against the inner tank wall by a plurality of pusher bars and a plurality of pusher plates Each pusher bar is associated with a different scissor hanger assembly so that a central mounting portion thereof is bolted to the shoe clip for the scissors hanger assembly and a pair of opposite resilient leg portions thereof extend outwardly from the opposite ends of the central mounting portion and into contact with the outer rim of the roof. Each of the pusher plates is disposed between a different adjacent pair of the pusher bars so that a mounting portion at one end thereof is bolted to the outer rim of the floating roof and a resilient leg portion thereof extends outwardly from the mounting portion and into contact with the shoe.

In a second embodiment of the shoe seal, the resilient elements disposed between the outer rim of the floating roof and the inner tank wall comprise only pusher bars. Each pusher bar is associated with a different scissors hanger assembly such that the central mounting portion thereof is bolted to the rim clip for the scissors hanger assembly and the pair of opposite resilient leg portions extend into contact with the shoe. Such arrangement has been found to be very effective in providing a distributed, relatively uniform force on the shoe so as to maximize contact of the shoe with the tank inner wall along the length of the shoe.

Shoe seals in accordance with the invention are easily assembled and installed without the need for welding Such shoe seals can be installed in tanks which are in service. Initial assembly of the shoe seal is accomplished by bolting the shoe clips of the scissors hanger assemblies to the shoe after the plates forming the shoe are joined together at their opposite ends. In the case of the first embodiment, the pusher bars are also bolted to the shoe clips In the case of the second embodiment, the pusher bars are bolted to the rim clips of the scissors hanger assemblies The resulting seal assembly is then lowered into the space between the floating roof and the inner tank wall where it is held in position while holes are drilled in the outer rim of the floating roof. The rim clips of the scissors hanger assemblies are then bolted to the floating roof In the case of the first embodiment, the pusher plates are also bolted to the outer rim of the floating roof Following mounting of the shoe assembly on the floating roof, the seal is then completed by disposing a vapor barrier fabric between the floating roof and the shoe The vapor barrier fabric is secured to the floating roof and to the shoe by bolting with the aid of channels

BRIEF DESCRIPTION OF THE DRAWINGS

The foregoing and other objects, features and advantages of the invention will be apparent from the following more particular description of preferred embodiments of the invention, as illustrated in the accompanying drawings, in which:

FIG. 11 is a top view similar to the view of FIG. 4 but illustrating a second embodiment of a shoe seal in accordance with the invention; and FIG. 12 is a perspective view of one of the scissors hanger assemblies of the shoe seal of FIG. 11 together with a modified rim clip in accordance with the second embodiment and showing the manner in which the pusher bars are coupled to the rim clips.

DETAILED DESCRIPTION OF THE INVENTION

Figure 1:
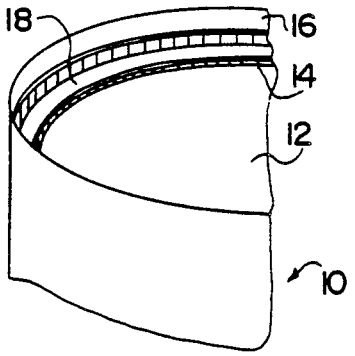
FIG. 1 is a perspective view of a portion of an oil storage tank having a floating roof and a seal between the outer rim of the floating roof and the inner tank wall.

FIG. 1 depicts a storage tank 10 having a floating roof 12 disposed therein The floating roof 12 floats on top of a liquid product such as oil stored within the tank 10.

To prevent hydrocarbon vapors from escaping into the atmosphere from the space between an outer rim 14 of the floating roof 12 and an inner tank wall 16, a seal 18 is provided. The seal 18 extends between the outer rim 14 of the floating roof and the inner tank wall 16 around the circumference of the floating roof 12, and acts as a barrier to hydrocarbon vapors. The seal 18 must be capable of movement up and down the inner tank wall 16 while maintaining a sealing relationship therewith, so that the floating roof 12 may rise or fall with varying quantities of liquid product stored in the tank 10.

The seal 18 may be of the shoe type in which a series of plates joined together and extending around the circumference of the floating roof 12 form a shoe which is mounted on the outer rim 14 of the floating roof 12. As described hereafter, shoe seals in accordance with the invention employ scissors hanger assemblies for hanging the shoe on the outer rim 14 in combination with resilient elements which force the shoe outwardly from the outer rim 14 of the floating roof 12 and into engagement with the inner tank wall 16.

Figure 2:
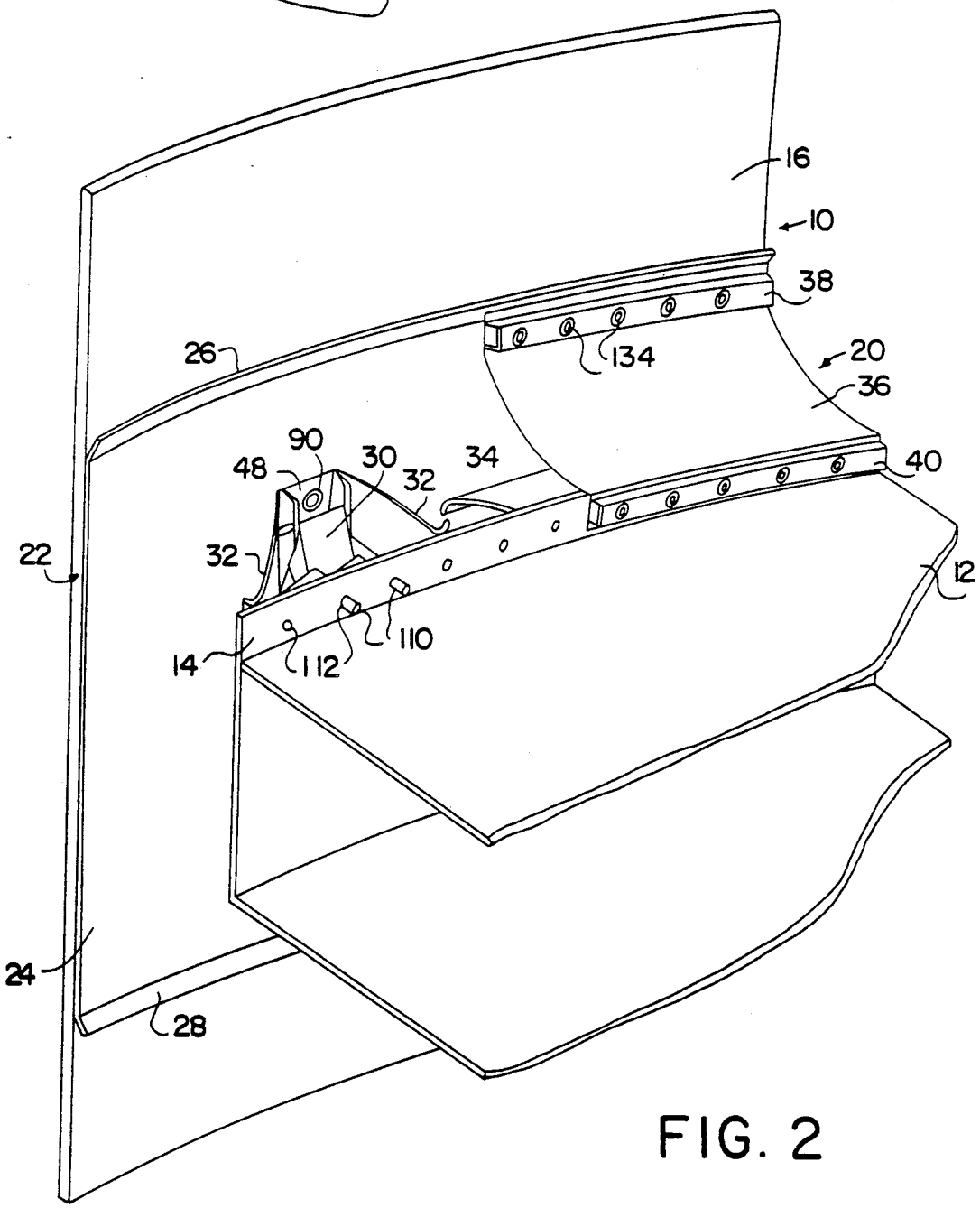
FIG. 2 is a perspective view of adjacent portions of an inner tank wall and the outer rim of a floating roof showing a first embodiment of a shoe seal in accordance with the invention.

FIGS. 2–10 depict a first embodiment of a shoe seal 20 in accordance with the invention FIG. 2 depicts a portion of the storage tank 10 of FIG. 1 including the inner tank wall 16 and a portion of the floating roof 12 including the outer rim 14. The roof 12 floats on oil or other liquid product stored within the tank 10, which product is not depicted in FIG. 2 for clarity of illustration.

The shoe seal 20 includes a shoe 22 comprised of a series of metal plates with one such plate 24 being shown in FIG. 2. The manner in which the metal plates such as the plate 24 of the shoe 22 are joined together in end-to-end fashion around the circumference of the floating roof 12 is described hereafter in connection with FIG. 10.

The plate 24 is bent outwardly from the inner tank wall 16 at the opposite upper and lower edges thereof to form upper and lower lips 26 and 28, respectively. The upper and lower lips 26 and 28 facilitate movement of the shoe 22 along the inner tank wall 16 as the floating roof 12 rises and falls with varying amounts of liquid product in the tank 10. The shoe 22 is capable of accommodating both welded tanks in which the seams between the plates forming the tank are welded together and riveted tanks in which the adjacent plates are riveted together with the rivet heads protruding slightly from the inner tank wall 16.

In addition to the shoe 22, the shoe seal 20 includes a plurality of scissors hanger assemblies 30 which mount the shoe 22 on the outer rim 14 in a manner permitting a substantial amount of movement of the shoe 22 relative to the outer rim 14. This permits the shoe 22 to be maintained in contact with the inner tank wall 16 in the presence of varying space between the outer rim 14 and the inner tank wall 16 about the circumference of the floating roof 12 and irregularities in the surface of the inner tank wall 16. The scissors hanger assemblies 30 are mounted in spaced apart fashion along the shoe 22, with one of the scissors hanger assemblies being shown in FIG. 2. The scissors hanger assemblies 30 are coupled to the shoe 22 by bolting and are mounted on the outer rim 14 of the floating roof 12 by bolting, as described in detail hereafter.

In addition to the shoe 22 and the scissors hanger assemblies 30, the shoe seal 20 includes resilient elements which are disposed in the space between the outer rim 14 and the shoe 22 and which serve to resiliently bias the shoe 22 in an outward direction from the outer rim 14. This serves to maintain the shoe 22 in engagement with the inner tank wall 16. In the embodiment of FIGS. 2–10, the resilient elements include a plurality of pusher bars 32 and a plurality of pusher plates 34. The pusher bars 32 are coupled to the shoe 22 and have opposite resilient legs which extend into contact with the outer rim 14. One such pusher bar 32 is shown in FIG. 2. The pusher plates 34 are mounted on the outer rim 14 and include a resilient leg portion which extends into contact with the shoe 22. One such pusher plate 34 is shown in FIG. 2.

To complete the shoe seal 20, a vapor barrier 36 is mounted so as to extend between the shoe 22 and the outer rim 14. Such vapor barrier 36 is provided by a length of vapor impermeable fabric, which is shown partly broken away in FIG. 2 so that the scissors hanger assembly 30 and the pusher bar 32 and pusher plate 34 may be seen. The vapor barrier 36 is joined to the shoe 22 by bolting along the length of a channel 38. The opposite edge of the vapor barrier 36 is bolted to the outer rim 14 through a channel 40.

Figure 3:
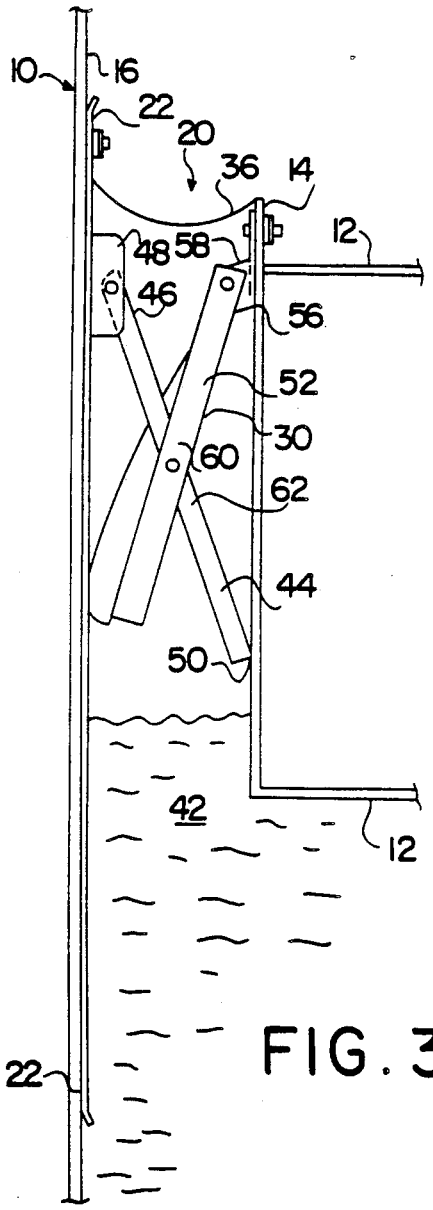
FIG. 3 is a side view of the shoe seal of FIG. 2.

FIG. 3 is a side view of the shoe seal 20 which shows a liquid product 42 within the tank 10. The liquid product 42 supports the floating roof 12. As shown in FIG. 3, the scissors hanger assembly 30 includes an elongated plate 44 having an upper end 46 pivotally coupled to a shoe clip 48. The shoe clip 48 is bolted to the shoe 22. The elongated plate 44 extends downwardly and outwardly from the shoe clip 48 and the shoe 22 and terminates at a lower end 50 thereof which contacts the floating roof 12. The scissors hanger assembly 30 also includes a pair of elongated bars 52 and 54 which are pivotally coupled at upper ends 56 thereof to a rim clip 58. The rim clip 58 is bolted to the outer rim 14 of the floating roof. The elongated bars 52 and 54 extend downwardly and outwardly from the rim clip 58 and the floating roof 12. Only the elongated bar 52 is seen in FIG. 3, inasmuch as the opposite elongated bar 54 is disposed therebehind on the other side of the elongated plate 44 therefrom The elongated bars 52 and 54 have intermediate portions 60 which are pivotally coupled to an intermediate portion 62 of the elongated plate 44.

The scissors hanger assemblies 30 mount or hang the shoe 22 on the floating roof 12 in a manner which permits considerable lateral movement of the shoe 22 relative to the floating roof 12. This enables the shoe seal 20 to accommodate substantial variations in the space between the inner tank wall 16 and the floating roof 12 around the circumference of the floating roof 12. The pusher bars 32 and the pusher plates 34 shown in FIG. 2 serve to resiliently urge the shoe 22 in a direction away from the floating roof 12 so as to maintain the shoe 22 against the inner tank wall 16. One of the pusher plates 34 is shown in FIG. 3. However, the pusher bars 32 are not shown in FIG. 3 for simplicity of illustration.

Figure 4:
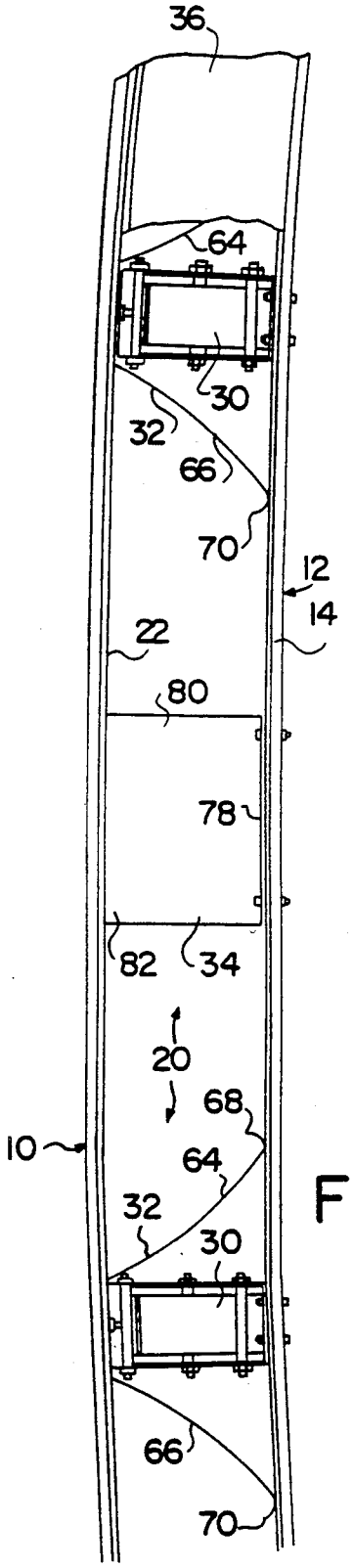
FIG. 4 is a top view of the shoe seal of FIG. 2.

As shown in FIG. 3 the shoe 22 extends down into the liquid product 42. This is one of the features of shoe seals which makes them effective. The vapor barrier 36 seals the space between the shoe 22 and the outer rim 14 of the floating roof 12, while at the same time flexing as necessary to permit lateral movement of the shoe 22 relative to the floating roof 12. Because the lower end of the shoe 22 is immersed in the liquid product 42, vapors from the liquid product 42 within the space between the shoe 22 and the floating roof 12 are trapped by the vapor barrier 36 The shoe 22 is normally in contact with the inner tank wall 16 so that no vapors from the liquid product 42 can pass therebetween. However, in instances where the shoe 22 pulls away from the inner tank wall 16 to form a small space therebetween, vapors from the liquid product 42 escaping through the small space are negligible FIG. 4 is a top view of the shoe seal 29 with most of the vapor barrier 36 removed to show the internal details of the shoe seal 20. As shown in FIG. 4 a different pusher bar 32 is mounted in conjunction with each of the scissors hanger assemblies 30. Each pusher bar 32 has an opposite pair of leg portions 64 and 66 of generally curved configuration which extend from the shoe 22 to the floating roof 12 where they terminate in curved end portions 68 and 70, respectively The resilient leg portions 64 and 66 act to urge the shoe 22 away from the floating roof 12

Figure 8:
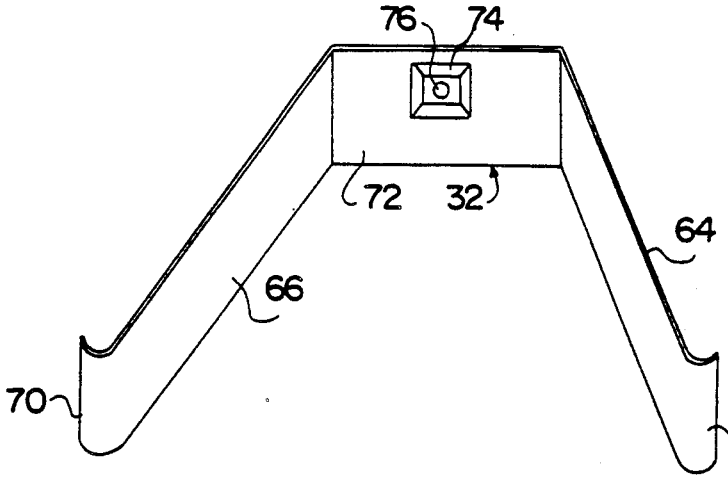
FIG. 8 is a perspective view of one of the pusher bars of the shoe seal of FIG. 2.

One of the pusher bars 32 is shown in detail in FIG. 8. The resilient leg portions 64 and 66 extend outwardly from the opposite ends of a central mounting portion 72 of flat rectangular configuration. The central mounting portion 72 has a recessed portion 74 therein with an aperture 76 therethrough. The recessed portion 74 receives a mating recessed portion of the shoe clip 48 to facilitate mounting of the pusher bar 32 in conjunction with the shoe clip 48 on the shoe 22.

As shown in FIG. 4 a different one of the pusher plates 34 is mounted between each adjacent pair of the scissors hanger assemblies 30 and the associated pusher bars 32. The pusher plate 34 includes a mounting portion 78 thereof which is bolted to the outer rim 14 of the floating roof 12. A resilient curved leg portion 80 extends outwardly from the mounting portion 78 to the shoe 22 where it terminates in a curved end portion 82.

Figure 9:
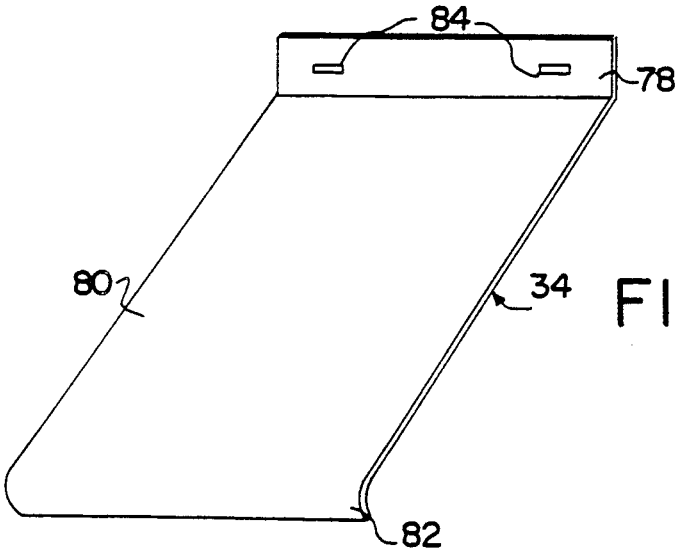
FIG. 9 is a perspective view of one of the pusher plates of the shoe seal of FIG. 2.

One of the pusher plates 34 is shown in detail in FIG. 9. As shown therein, the mounting portion 78 has opposite apertures 84 therein The apertures 84 receive bolts for mounting the pusher plate 34 on the outer rim 14 of the floating roof 12 as described in detail hereafter.

Figure 5:
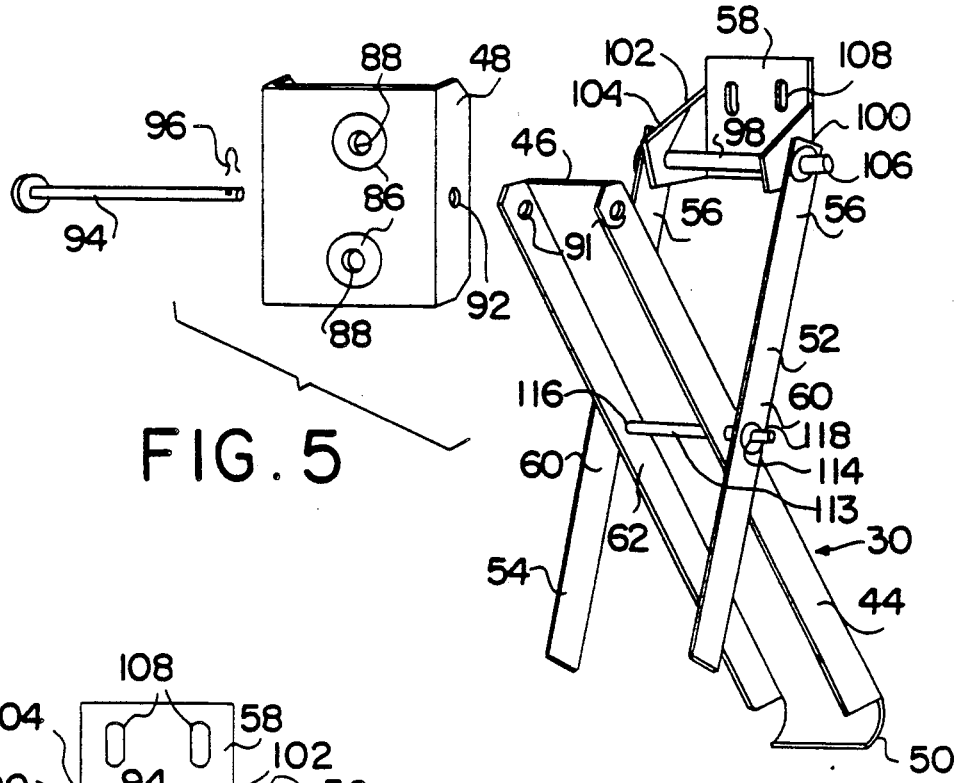
FIG. 5 is a perspective, exploded view of one of the scissors hanger assemblies of the shoe seal of FIG. 2 including the associated shoe clip and rim clip.

FIG. 5 shows the scissors hanger assembly 30 together with the shoe clip 48 and the rim clip 58. The shoe clip 48 has a pair of recessed portions 86 therein with apertures 88 extending therethrough. Either of the recessed portions 86 is capable of accommodating the recessed portion 74 of the central mounting portion 72 of the pusher bar 32, to snugly dispose the pusher bar 32 between the shoe clip 48 and the shoe 22. A pair of bolts 90, one of which is shown in FIG. 2, are then inserted through the apertures 88 in the shoe clip 48 and through the aperture 76 in the central mounting portion 72 of the pusher bar 32, and finally through mating apertures in the shoe 22 to mount the shoe clip 48 and the pusher bar 32 on the shoe 22.

Figure 6:
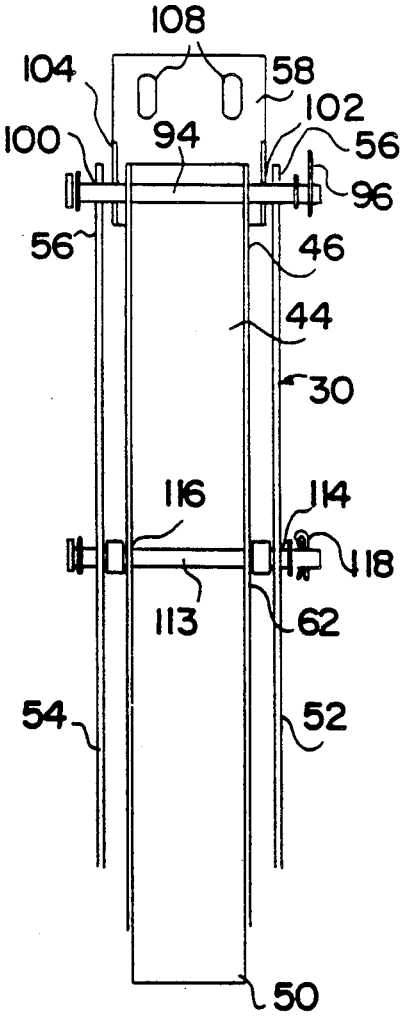
FIG. 6 is a front view of the scissors hanger assembly of FIG. 5 together with the rim clip.

As seen in FIGS. 5 and 6, the upper end 46 of the elongated plate 44 has opposite apertures 91 therein. The shoe clip 48 has opposite apertures 92 therein. The upper end 46 of the elongated plate 44 is pivotally coupled to the shoe clip 48 by a pin 94 which is inserted through the apertures 92 in the clip 48 and the apertures 91 in the upper end 46 of the elongated plate 44. The pin 94 is secured in place by a cotter pin 96 which is installed in the end thereof.

The upper ends 56 of the elongated bars 52 and 54 which are disposed on opposite sides of the elongated plate 44 are pivotally coupled to the rim clip 58 by a pin 98. The pin 98 is inserted through apertures 100 in the upper ends 56 of the elongated bars 52 and 54 and apertures 102 in a pair of opposite arms 104 of the rim clip 58. The pin 98 is secured in place by a hair(hitch) pin 106 installed in the end thereof.

As shown in FIGS. 5 and 6, the rim clip 58 is provided with a pair of apertures 108 therein to facilitate mounting of the rim clip 58 on the outer rim 14 of the floating roof 12. The rim clip 58 is mounted on the outer rim 14 by a pair of bolts 110 which are inserted through the apertures 108 and through apertures 112 in the outer rim 14 of the floating roof 12, as shown in FIGS. 2 and 7.

Figure 7:
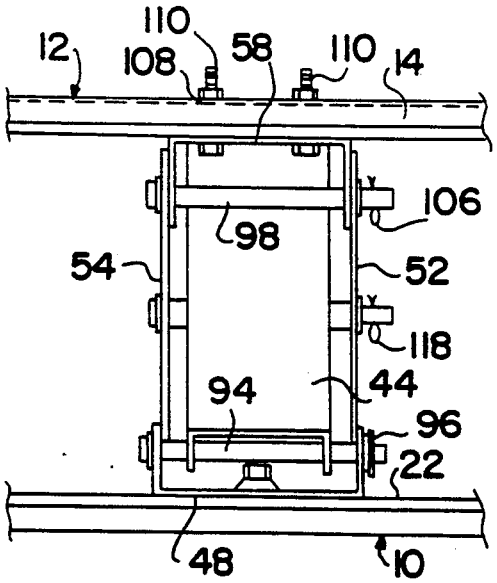
FIG. 7 is a top view of the scissors hanger assembly of FIG. 5 installed between the shoe and the outer rim of the floating roof.

As previously noted, the intermediate portions 60 and 62 of the elongated rods 52 and 54 and the elongated plate 44, respectively, are pivotally coupled together As shown in Figs. 5-7, this is accomplished by a pin 113 which extends through apertures 114 in the intermediate portions 60 of the opposite elongated rods 52 and 54 and through apertures 116 in the elongated plate 44. The pin 113 is held in place by a hair (hitch) pin 118 which is mounted in an end of the pin 113.

Figure 10:
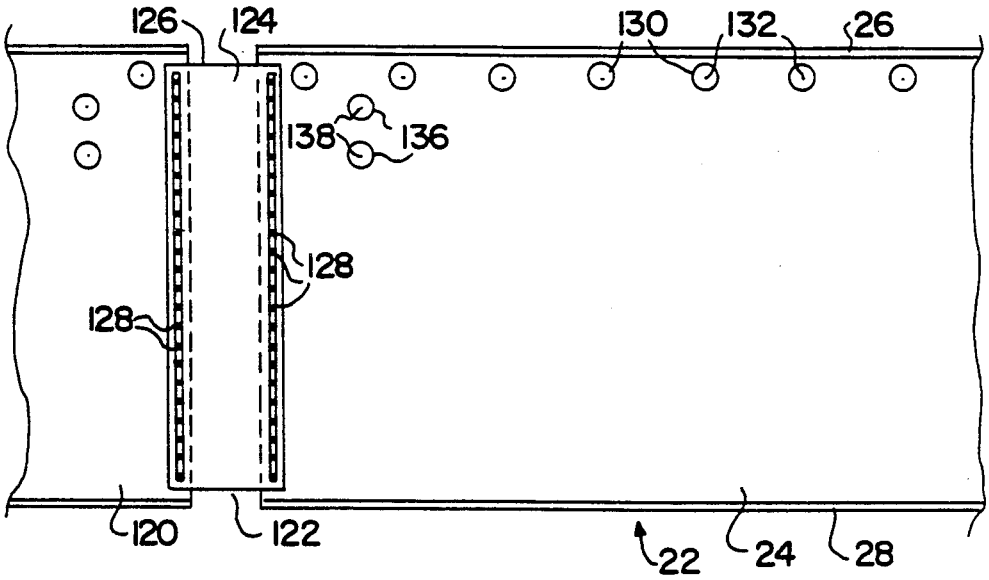
FIG. 10 is a plan view of the shoe used in the shoe seal of FIG. 2 showing portions of two adjacent shoe plates as joined together.

The shoe 22 is shown in detail in FIG. 10 As previously noted, the shoe 22 is comprised of a series of plates joined together in end-to-end fashion A substantial portion of the plate 24 is shown in FIG. 10 together with a portion of an adjacent plate 120. The adjacent edges of the plates 24 and 120 are spaced apart to form a small gap 122 therebetween in which an expansion joint 124 is installed. The expansion joint 124 includes a piece of fabric 126 extending between the adjacent edges of the plates 24 and 120, together with a foam filler (not shown) disposed between a back side of the fabric 126 and an adapter plate (not shown) which extends between the edges of the plates 24 and 120 on the opposite sides thereof The various portions of the expansion joint 124 including the fabric 126 are joined together and to the adjacent edges of the plates 24 and 120 by a series of nuts and bolts 128 extending through apertures in the adjacent edges of the plates 24 and 120. The expansion joint 124 provides the shoe 22, the plates 24 and 120 of which extend around the curved inner tank wall 16, with additional flexibility. This additional flexibility accommodates expansion and contraction of the metal plates 24 and 120 as well as irregularities in the inner tank wall 16.

As shown in FIG. 10, each of the plates 24 and 120 of the shoe 22 is provided with a series of recesses 130 with apertures 132 therein and forming a row adjacent the top edge of each plate 24 and 120. The recesses 130 and the apertures 132 accommodate a plurality of bolts 134. The bolts 134 which are shown in FIG. 2 extend through the vapor barrier 36 and the channel 38 and into mating nuts to secure the upper edge of the vapor barrier 36 to the shoe 22.

As shown in FIG. 2, the outer rim 14 of the floating roof 12 is provided with the apertures 112 arranged in a row adjacent the upper edge thereof The apertures 112 receive the bolts 110 which extend through a lower edge of the vapor barrier 36 and through the channel 40 to mating nuts in order to secure the lower edge of the vapor barrier 36 to the outer rim 14. Pairs of the bolts 110 also mount the pusher plates 34 to the outer rim 14 by extending through the apertures 84 in the mounting portion 78 of each pusher plate 34.

As shown in Fig 10, each of the plates 24 and 120 is also provided with spaced apart columns of paired recesses 136 having apertures 138 extending therethrough. The pairs of apertures 138 receive pairs of bolts including the bolt 90 shown in FIG. 2 to mount the shoe clips 48 of the scissors hanger assemblies 30 on the shoe 22 together with the pusher bars 32.

It will be appreciated that shoe seals in accordance with the invention such as the shoe seal 20 of FIGS. 2-10 are easily assembled and installed without the need for any welding. This permits the shoe seals to be installed in a tank which is in service. The tank does not have to be drained of its liquid product and the fumes therefrom removed, as is the case with the installation of most conventional floating roof seals.

The shoe seal 20 of FIGS. 2-10 is preassembled by first bolting the shoe clips 48 of the various scissors hanger assemblies 30 to the shoe 22 together with the pusher bars 32. The shoe 22 with scissors hanger assemblies 30 and pusher bars 32 mounted thereon is then lowered into the space between the outer rim 14 of the floating roof 12 and the inner tank wall 16 where it is temporarily held in place. This can be accomplished using ropes attached to and suspending the shoe 22 from overhead pulleys. The opposite resilient leg portions 64 and 66 of the pusher bars 32 are manually bent as necessary so as to fit into the space between the inner tank wall 16 and the outer rim 14 of the floating roof 12.

With the shoe 22 and the included scissors hanger assemblies 30 and pusher bars 32 temporarily held in place, the apertures 112 are drilled in the outer rim 14 of the floating roof 12.

Following the drilling of the apertures 112, the rim clips 58 of the scissors hanger assemblies 30 are bolted to the outer rim 14 of the floating roof 12. This is accomplished using the bolts 110 which are inserted through the apertures 108 in the rim clips 58 and through the apertures 112 in the outer rim 14 of the floating roof 12. The pusher plates 34 are also installed by inserting bolts through the apertures 84 in the mounting portion 78 of each pusher plate 34 and through the apertures 112 in the outer rim 14. The resilient leg portion 80 of the pusher plate 34 is manually bent as necessary to fit the pusher plate 34 into the space between the shoe 22 and the outer rim 14 while the mounting portion 78 of the pusher plate 34 is bolted in place Following bolting of the rim clips 58 to the outer rim 14 and installation of the pusher plates on the outer rim 14, the shoe seal 20 is completed by installing the vapor barrier 36 The bolts 134 are inserted through the apertures 132 in the shoe 22, then through the upper edge of the vapor barrier 36 and through the channel 38 into mating nuts. This secures the upper edge of the vapor barrier 36 to the shoe 22. The vapor barrier 36 extends from the upper edge of the shoe 22 to the outer rim 14 where the lower edge of the vapor barrier is folded over the outer rim 14 and secured in place by the bolts 110. The bolts 110 extend through the lower edge of the vapor barrier 36 and through the channel 40 to mating nuts FIGS. 11 and 12 depict a shoe seal 140 comprising a second embodiment in accordance with the invention. The shoe seal 140 is essentially like the shoe seal 20 of FIGS. 2–10, with several differences. Unlike the shoe seal 20 of FIGS. 2–10, the shoe seal 140 has no pusher plates 34. The shoe seal 140 instead relies exclusively on the pusher bars 32 to resiliently urge the shoe 22 against the inner tank wall 16. To do so, the pusher bars 32 are mounted on the outer rim 14 of the floating roof 12 instead of on the shoe 22. Also, the pusher bars 32 are lowered slightly from the positions they assume in the shoe seal 20 of FIGS. 2–10. This is accomplished by bolting the pusher bars 32 to the lower ends of relatively long rim clips 142.

One of the rim clips 142 is shown in FIG. 12 together with an associated one of the scissor hanger assemblies 30 and associated one of the pusher bars 32. The rim clip 142 is like the rim clip 58 of the shoe seal 20 of FIGS. 2–10 in that it has the opposite arms 104 for receiving the pin 98 and the pair of apertures 108 for bolting the rim clip 142 to the outer rim 14 of the floating roof 12. However, the rim clip 142 has an elongated body portion which extends downwardly to a lower end 144 thereof The central mounting portion 72 of the pusher bar 32 is coupled to the lower end 144 of the rim clip 142 by a pair of bolts 146.

As shown in FIG. 11, the opposite resilient leg portions 64 and 66 of the pusher bar 32 extend outwardly from the outer rim 14 and into contact with the shoe 22 at the curved end portions 68 and 70 thereof Although the shoe seal 140 of Figs. 11 and 12 does not include the pusher plates 34, such arrangement has been found to provide a relatively uniform, distributed force on the shoe 22 by virtue of the opposite leg portions 64 and 66 of the pusher bars 32. As a result, the shoe seal 140 has been found to be particularly effective in maintaining substantially all of the shoe 22 in contact with the tank inner wall 16.

Installation of the shoe seal 140 is similar to installation of the shoe seal 20, except for a few differences. In the case of the shoe seal 140, the scissors hanger assemblies 30 are bolted to the shoe 22 without the pusher bars 32. Instead, the pusher bars 32 are bolted to the lower ends 144 of the rim clips 142 of the scissors hanger assemblies 30. The resulting assembly is lowered into the space between the outer rim 14 of the floating roof 12 and the inner tank wall 16 and temporarily held in such position The opposite leg portions 64 and 66 of the pusher bars 32 are manually bent as necessary to allow the scissors hanger assemblies 30 and the included pusher bars 32 to fit into the space between the outer rim 14 and the inner tank wall 16.

After the apertures 112 are drilled in the outer rim 14 of the floating roof 12, the rim clips 142 are bolted to the outer rim 14 using the bolts 110 which are inserted through the apertures 108 in the rim clip 142. The vapor barrier 36 is then installed in the manner previously described in connection with FIGS. 2–10.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A sealing arrangement for use between an inner tank wall of a tank and a floating roof floating on a liquid product within the tank, comprising the combination of:

a shoe disposed adjacent the inner tank wall;

a plurality of scissors hanger assemblies attached by coupling means utilizing other than welding to the floating roof and coupled to the shoe to permit movement of the shoe relative to the floating roof, the coupling means being above the liquid product and constituting the sole effective attachment of the scissors hanger assemblies to the floating roof;

resilient means disposed between the shoe and the floating roof separate from the scissors hanger assemblies for urging the shoe away from the floating roof and toward the inner tank wall; and a vapor barrier extending between the shoe and the floating roof.

2. The invention set forth in claim 1, wherein the resilient means includes a plurality of pusher plates, each having a mounting portion at one end thereof and a resilient leg portion extending outwardly from the mounting portion.

3. The invention set forth in claim 2, wherein the plurality of pusher plates are spaced apart along the floating roof with the mounting portion of each being coupled solely and other than by welding to the floating roof above the liquid product and the resilient leg portion of each extending into contact with the shoe.

4. The invention set forth in claim 1, wherein the resilient means includes a plurality of pusher bars each having a central mounting portion and a pair of opposite resilient leg portions extending outwardly from opposite ends of the central mounting portions.

5. The invention set forth in claim 4, wherein the plurality of pusher bars are spaced apart along the floating roof with the central mounting portion of each being coupled solely and other than by welding to the floating roof above the liquid product and the pair of opposite resilient leg portions extending into contact with the shoe.

6. The invention set forth in claim 4, wherein the central mounting portion of each pusher bar is coupled to the shoe and the pair of opposite resilient leg portions extend into contact with the floating roof.

7. The invention set forth in claim 6, wherein the resilient means further includes a plurality of pusher plates, each being disposed between a different pair of the pusher bars and having a mounting portion at one end thereof coupled solely and other than by welding to the floating roof above the liquid product and a resilient leg portion extending outwardly from the mounting portion and into contact with the shoe.

8. The invention set forth in claim 1, wherein the coupling means comprises bolts.

9. An arrangement for mounting a sealing shoe on a floating roof in a tank containing a liquid product comprising the combination of:

a plurality of shoe clips mounted in spaced-apart relation along the shoe;

a plurality of rim clips, each mounted on the floating roof above the liquid product and opposite a different one of the plurality of shoe clips;

a plurality of elongated plates, each having a first end pivotally coupled at opposite sides thereof to a different one of the shoe clips and an opposite second end extending to and uncoupled from the floating roof;

a plurality of pairs of elongated bars, the bars of each pair having first ends pivotally coupled to a different one of the rim clips and intermediate portions pivotally coupled to an intermediate portion of one of the elongated plates pivotally coupled to the shoe clip opposite the rim clip; and means disposed between the shoe and the floating roof for resiliently urging the shoe away from the floating roof.

10. The invention set forth in claim 9, wherein the means for resiliently urging comprises a plurality of pusher bars and a plurality of pusher plates, each of the pusher bars having a central mounting portion coupled to a different one of the plurality of shoe clips and an opposite pair of resilient leg portions extending into contact with the floating roof, and each of the pusher plates being disposed between a different pair of the pusher bars and having a mounting portion coupled to the floating roof above the liquid product and a resilient leg portion extending into contact with the shoe.

11. The invention set forth in claim 9, wherein the means for resiliently urging comprises a plurality of pusher bars, each having a central mounting portion coupled to a different one of the plurality of rim clips and an opposite pair of resilient leg portions extending into contact with the shoe.

12. A sealing arrangement for installation between an inner wall and a floating roof within a tank in service with a liquid product therein, comprising the combination of:

a shoe;

a plurality of scissors hanger assemblies coupled to the shoe and each being coupled to the floating roof above the liquid product by bolts which constitute the sole effective attachment of the plurality of scissors hanger assemblies to the floating roof;

a plurality of resilient members for bolting in place so as to extend between the shoe and the floating roof; and a vapor barrier coupled to the shoe and extending to and being bolted to the floating roof.

13. The invention set forth in claim 12 wherein each of the scissors hanger assemblies has a shoe clip bolted to the shoe and a rim clip bolted to the floating roof above the liquid product.

14. The invention set forth in claim 12, wherein at least some of the resilient members are bolted to different ones of the scissors hanger assemblies.

15. The invention set forth in claim 13, wherein at least some of the resilient members are bolted to the floating roof above the liquid product.

16. An arrangement for mounting a sealing shoe on a floating roof in a tank while the tank is in service and contains a liquid product, comprising the combination of:

a plurality of shoe clips mounted in spaced-apart relation along the shoe;

a plurality of rim clips, each being bolted to the floating roof above the liquid product and opposite a different one of the plurality of shoe clips;

a plurality of elongated plates, each having a first end pivotally coupled at opposite sides thereof to a different one of the shoe clips and an opposite second end extending to and uncoupled from the floating roof;

a plurality of pairs of elongated bars, the bars of each pair having first ends pivotally coupled to a different one of the rim clips and intermediate portions pivotally coupled to an intermediate portion of one of the elongated plates pivotally coupled to the shoe clip opposite the rim clip;

a plurality of pusher bars disposed between the shoe and the floating roof for resiliently urging the shoe away from the floating roof, each of the pusher bars having a central mounting portion coupled to a different one of the plurality of shoe clips and an opposite pair of resilient leg portions extending into contact with the floating roof; and a vapor barrier extending between the shoe and the floating roof.

17. The invention set forth in claim 16, further including a plurality of pusher plates disposed between the shoe and the floating roof for resiliently urging the shoe away from the floating roof, each of the pusher plates being disposed between a different pair of the pusher bars and having a mounting portion bolted to the floating roof and a resilient leg portion extending into contact with the shoe.

* * * * *

UNITED STATES PATENT AND TRADEMARK OFFICE

CERTIFICATE OF CORRECTION

PATENT NO. : 5,103,992

DATED : April 14, 1992

INVENTOR(S) : Patrick L. Lippiello and David W. Otto

It is certified that error appears in the above-identified patent and that said Letters Patent is hereby corrected as shown below:

Col. 1, line 21, after "varies" insert --.--.

Col. 1, lines 35 and 38, after "al" insert --.--.

Col. 1, line 44, after "tank" insert --.--.

Col. 1, line 47, after "shoe seal" insert --.--.

Col. 2, line 10, after "wall" insert --.--.

Col. 2, line 54, after "service" insert --.--.

Col. 2, line 58, after "roof" insert --.--.

Col. 2, line 61, after "wall" insert --.--.

Col. 2, line 64, after "shoe" insert --.--.

Col. 3, line 1, after "thereof" insert --.--.

Col. 3, line 6, after "roof" insert --.--.

Col. 3, line 14, after "plates" insert --.--.

Col. 3, line 15, delete "scissor" and substitute --scissors--.

Col. 3, line 41, after "welding" insert --.--.

Col. 3, line 48, after "clips" insert --.--.

Col. 3, line 50, after "assemblies" insert --.--.

Col. 3, lines 56 and 58, after "roof" insert --.--.

Col. 3, line 62, after "shoe" insert --.--.

Col. 3, line 63, after "channels" insert --.--.

Col. 4, line 40, after "therein" insert --.--.

UNITED STATES PATENT AND TRADEMARK OFFICE

CERTIFICATE OF CORRECTION

PATENT NO. : 5,103,992

DATED : April 14, 1992

INVENTOR(S) : Patrick L. Lippiello and David W. Otto

It is certified that error appears in the above-identified patent and that said Letters Patent is hereby corrected as shown below:

Col. 4, line 66, after "invention" insert --.--.

Col. 6, line 16, after "therefrom" insert --.--.

Col. 6, line 42, after "barrier 36" insert --.--.

Col. 6, line 57, after "respectively" insert --.--.

Col. 6, line 59, after "roof 12" insert --.--.

Col. 7, line 11, after "therein" insert --.--.

Col. 7, line 55, after "together" insert --.--.

Col. 7, line 62, after "FIG. 10" insert --.--.

Col. 7, line 64, after "fashion" insert --.--.

Col. 8, lines 7 and 29, after "thereof" insert --.--.

Col. 9, line 15, after "place" insert --.--.

Col. 9, line 19, after "barrier 36" insert --.--.

Col. 9, line 29, after "nuts" insert --.--.

Col. 9, lines 53 and 59, after "thereof" insert --.--.

Col. 10, line 10, after "position" insert --.--.

Col. 12, line 18 (line 1 of claim 15) after "claim" and before "wherein", "13," should be "14,".

UNITED STATES PATENT AND TRADEMARK OFFICE

CERTIFICATE OF CORRECTION

PATENT NO. : 5,103,992
DATED : April 14, 1992
INVENTOR(S) : Patrick L. Lippiello, et. al.

It is certified that error appears in the above-indentified patent and that said Letters Patent is hereby corrected as shown below:

Col. 12, line 18, after "claim" and before "wherein", "13," should be "14,".

Signed and Sealed this

Ninth Day of November, 1993

Bruce Lehman

*Attest:*

BRUCE LEHMAN

*Attesting Officer*

*Commissioner of Patents and Trademarks*